United States Patent [19]

Smallwood

[11] Patent Number: 4,874,340

[45] Date of Patent: Oct. 17, 1989

[54] COMBINED AMUSEMENT DEVICE AND TRANSPORT AND STORAGE PACK

[76] Inventor: Alice R. Smallwood, 1517 Montclair Dr., Plano, Tex. 75075

[21] Appl. No.: 222,155

[22] Filed: Jul. 21, 1988

[51] Int. Cl.[4] ..... A63H 33/00; A47C 20/02; A45F 4/02; B42D 3/00

[52] U.S. Cl. ..... 446/28; 446/72; 446/369; 5/434; 5/442; 224/153; 281/29

[58] Field of Search ..... 446/74, 73, 72, 369, 446/327, 98, 147, 28, 26; 281/15 R, 1, 29, 31, 34; 283/63 R; 224/153, 209; 5/434, 437, 442

[56] References Cited

U.S. PATENT DOCUMENTS

| | | | |
|---|---|---|---|
| 1,306,691 | 6/1919 | Goetz | 281/15 R |
| 1,575,263 | 3/1926 | Guglielmi | 446/72 |
| 2,828,975 | 4/1958 | Wright | 281/31 X |
| 3,048,424 | 8/1962 | Mitchell, Jr. | 281/31 X |
| 3,715,816 | 2/1973 | White | 281/29 |
| 3,778,925 | 12/1973 | Owen | 446/74 |
| 4,122,628 | 10/1978 | Crowell et al. | 446/98 X |
| 4,152,865 | 5/1979 | Ikeda | 446/72 |
| 4,227,270 | 10/1980 | Rivera | 5/434 X |
| 4,423,834 | 1/1984 | Rush | 446/369 X |
| 4,458,372 | 7/1984 | Mills | 446/72 X |
| 4,508,515 | 4/1985 | Skolnick | 446/327 X |
| 4,662,550 | 5/1987 | O'Donnell | 224/153 X |

FOREIGN PATENT DOCUMENTS

| | | | |
|---|---|---|---|
| 138982 | 10/1934 | Austria | 224/153 |

*Primary Examiner*—Mickey Yu
*Attorney, Agent, or Firm*—W. Kirk McCord

[57] ABSTRACT

A combined children's amusement device and transport and storage pack is constructed of first and second substantially rectangular members having a central portion disposed therebetween for joining the first and second members together. Each member has opposite inner and outer major surfaces. A three dimensional object, such as a stuffed toy, is substantially permanently attached to an outer major surface of one of the members and a children's story imprinted on a fabric material is attached on the inside of the device so that the fabric material is sandwiched between the first and second members when the first and second members are folded together. The fabric material containing the children's story is preferably removably attached to the central portion between the first and second members so that the fabric material is detachable by means of moderate force exerted thereon by a user. The inner major surface of each rectangular member is constructed of a plurality of fabric panels in overlapping relationship to define first and second storage pouches. The stuffed toy has attachment elements positioned at selected locations thereon for allowing a user to attach articles, such as articles of play clothing, directly to the stuffed toy. A carrying handle is provided and a plurality of loops are secured to the item for receiving a plurality of straps to allow the item to be carried as a backpack when the two rectangular members are folded together.

16 Claims, 3 Drawing Sheets

COMBINED AMUSEMENT DEVICE AND TRANSPORT AND STORAGE PACK

FIELD OF THE INVENTION

This invention relates to children's amusement devices and in particular to a children's amusement device which can also be used as a transport and storage pack.

BACKGROUND OF THE INVENTION

Children are fond of playing and sleeping with "favorite toys", which are often stuffed with a soft material. Oftentimes, while a child is asleep, his stuffed toy will fall out of the child's bed or otherwise end up beyond the child's reach. If the child wakes up and realizes that his stuffed toy is "gone", he may become distressed and cry out until his toy is returned to him. This scenario not only results in interruption of sleep for the child, but also for the adult or other person who has to come to the rescue.

DESCRIPTION OF THE PRIOR ART

Dolls and stuffed toys are well known in the art. It is also known to combine children's toys with items having other uses, such as storage packs and the like. For example, U.S. Pat. No. 4,372,077 discloses a combined storybook, flannel board with toy figures and hand puppet. The puppet includes a storage pocket to receive the story book, flannel board and toy figures therein. U.S. Pat. Nos. 1,638,594 and 4,715,840 disclose combined purses and stuffed animals. U.S. Pat. Nos. 4,458,372; 4,734,948 and 4,739,529 teach convertible objects which can take the form of a stuffed doll or toy in one configuration and a relatively flat cover or sleeping bag in another configuration.

There is also at least one product currently on the market, which is configured as a dual section pillow with a decorative design on the outside of one of the sections. A children's story is imprinted on a cloth material and permanently attached on the inside of the pillow. Storage pockets are also included on the inside of the pillow.

One problem associated with such prior art children's amusement devices is that the toys are not permanently attached to the child's pillow so that the toy will not become separated from the child during the night. Even though it is known in the art to put pictorial designs on children's pillows, such designs are typically of two dimensions only and do not provide the "warm, fuzzy" feeling that a three dimensional stuffed toy does.

OBJECTS OF THE INVENTION

It is therefore the principal object of the invention to provide an improved children's amusement device, which can also be used as a child's pillow and as a transport and storage pack for other children's items.

It is another object of the invention to provide a children's pillow on which a three dimensional stuffed toy is permanently attached.

It is yet another object of the invention to provide a children's pillow having storage pockets for storing and transporting children's items.

It is still another object of the invention to provide a transport and storage pack, which can be conveniently carried by hand or worn as a backpack.

SUMMARY OF THE INVENTION

These and other objects are accomplished in accordance with the present invention wherein a device is comprised of first and second members having a central portion disposed therebetween for joining the first and second members and a three dimensional object attached to a major surface of one of the members. The first and second members are foldable along the central portion so that respective distal edges of the first and second members are substantially in contact to define a substantially closed configuration when the members are folded along the central portion.

In one embodiment each member has opposite inner and outer major surfaces. The three dimensional object is attached to the outer major surface of the first member. The respective inner major surfaces of the two members are in facing relationship when the members are folded along the central portion. In another embodiment the three dimensional object is comprised of a stuffed toy.

In yet another embodiment a children's story is imprinted on a fabric material, which is removably attached on the inside of the device so that the fabric material is sandwiched between the first and second members when the members are folded together. In still another embodiment handle means is attached to one edge of the device adjacent to the central portion to facilitate manual engagement of the device by a user. In another embodiment of the invention first and second loops are disposed adjacent to a first edge of the first member and a third loop is disposed adjacent to a second edge of the first member, opposite from the first edge thereof, for receiving a plurality of straps therethrough to allow the device to be carried as a backpack when the members are folded together. In yet another embodiment of the invention the inner major surface of each of the members has at least one storage pouch.

In the preferred embodiment the stuffed toy is attached to the outer major surface of the first member along at least portions of the perimeter of the head and torso of the toy. The toy has attachment means disposed at selected locations thereon for allowing the user the attach articles, such as articles of play clothing, to the toy. The inner major surface of each member is preferably comprised of first, second, third and fourth panels. The second panel overlaps a portion of the first panel to define a first pouch, the third panel overlaps a portion of the second panel a portion of the second panel to define a second pouch and the fourth panel overlaps a portion of the first panel which is not overlapped by the second panel to conceal the first pouch. Securing means is positioned at selected locations along the respective distal edges of the first and second members to hold the respective distal edges in contact when the sections are folded together.

BRIEF DESCRIPTION OF THE DRAWINGS

Further objects and advantages of the invention will be apparent from the detailed description and claims when read in conjunction with the accompanying drawings wherein:

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
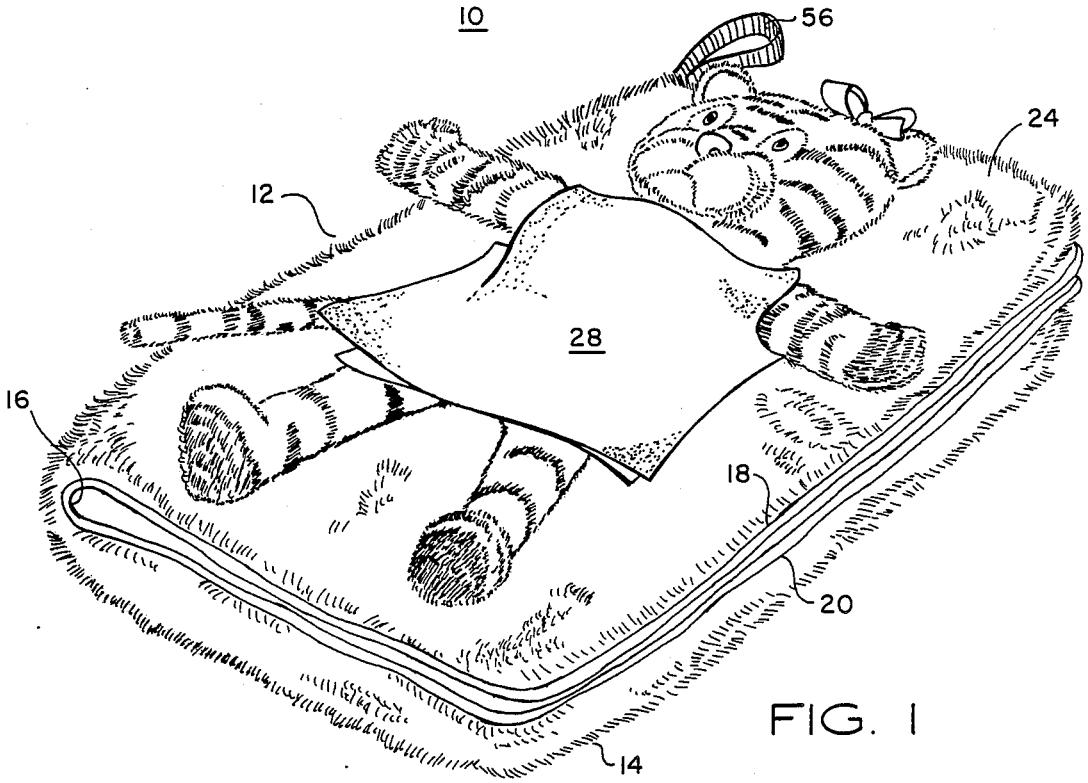
FIG. 1 is a perspective view of the combined amusement device and transport and storage pack according to the present invention, showing the device in a folded configuration.

Referring to FIGS. 1–5, an amusement device 10 is comprised of first and second substantially rectangular members 12 and 14 having a central portion 16 disposed therebetween. First and second members 12 and 14 are foldable along central portion 16 in much the same manner as sections of a book are folded along the spine of the book to define a closed or folded configuration, as depicted in FIG. 1. When device 10 is in a folded or closed configuration, respective first and second distal edges 18 and 20 of first and second members 12 and 14 are substantially in contact with one another.

A toy figure, such as stuffed toy 22, is substantially permanently attached to outer major surface 24 of first member 12. Toy 22 is preferably attached to outer major surface 24 along the perimeter of the head and torso of toy 22 so that the legs, arms and tail of toy 22 are free to move in any direction to enhance the enjoyment derived by a child user. Toy 22 is a three dimensional object, which further enhances the enjoyment derived by the child. First and second members 12 and 14 and toy 22 are preferably stuffed with shredded foam material to provide a soft "pillow" feel.

Figure 4:
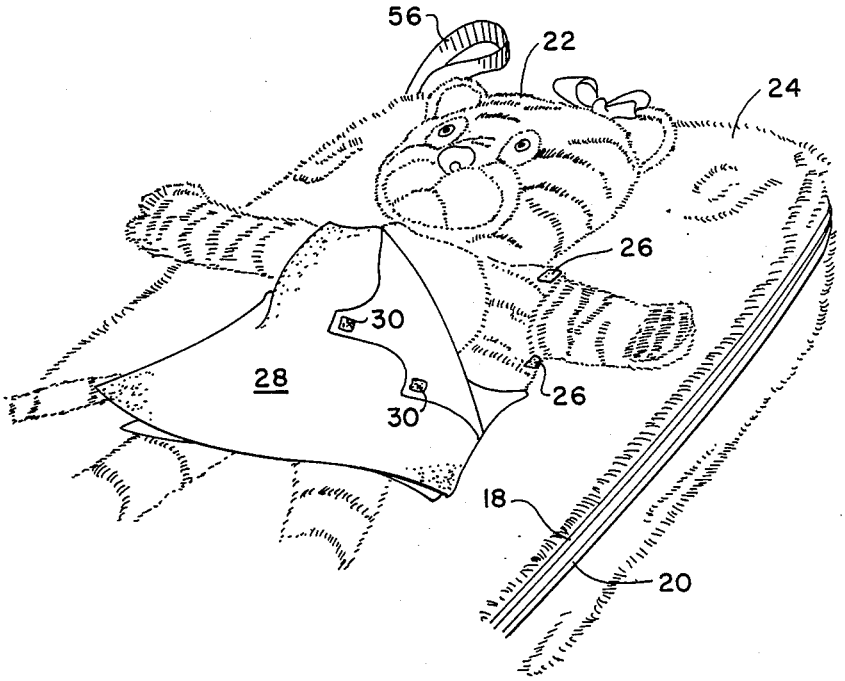
FIG. 4 is a perspective view of a portion of the device in a folded position, showing the feature of the invention by which articles of play clothing are attachable to the stuffed toy attached to an outer major surface of the device.

Referring specifically to FIGS. 1 and 4, toy 22 preferably has a plurality of first attachment members 26 disposed at selected locations on toy 22. Although not all of them are shown in FIGS. 1 and 4, first attachment members 26 are preferably disposed along the perimeter of the head and torso of toy 22 so as to substantially coincide with the lines of attachment of toy 22 to outer major surface 24. In addition, first attachment members 26 may also be disposed behind the ears of toy 22 to allow jewelry and other play items to be attached. Items such as articles of play clothing 28 having second attachment members 30 affixed thereto, which are complementary with first attachment members 26, may be fastened to toy 22 to allow the child user to "dress" and "undress" toy 22 and to add other novelty items, such as necklaces, bonnets, earrings and the like. Complementary first and second attachment members 26 and 30 are preferably comprised of complementary fabric tapes, one of which is comprised of flexible resilient monofilament material to define a plurality of hook elements and the other of which is comprised of a pile fabric face to define a plurality of loop elements. The intermeshing or locking of the hook elements with the loop elements provides a bond a considerable strength, yet one which can be readily disengaged by the exertion of moderate force by a child user. First and second attachment members 26 and 30 are preferably of the type sold by Velcro Corporation of New York, New York under the trademark "Velcro".

Figure 2:
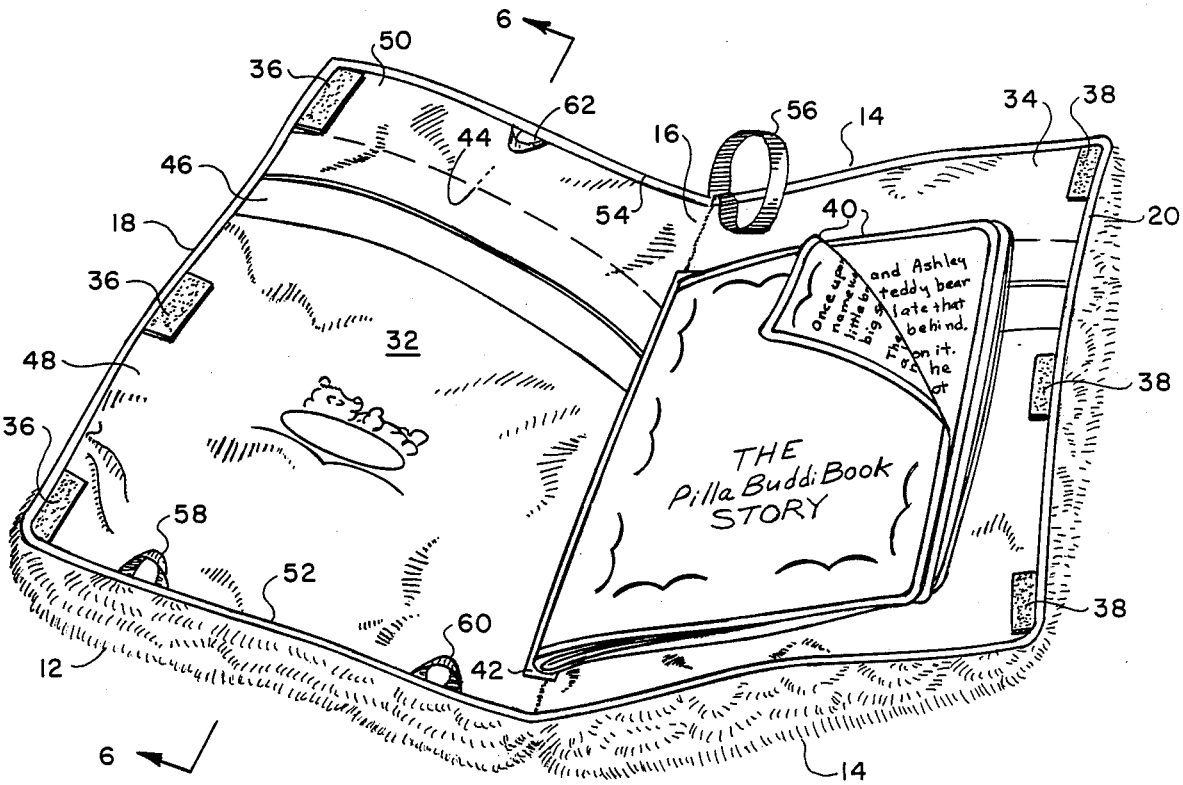
FIG. 2 is a perspective view of the device depicted in FIG. 1, showing the device in an unfolded configuration with the interior portion thereof visible.

Referring specifically to FIG. 2, the interior portion of device 10 is comprised of respective first and second inner major surfaces 32 and 34 associated with respective first and second members 12 and 14. When first and second members 12 and 14 are folded together, as depicted in FIGS. 1 and 4, first and second inner major surfaces 32 and 34 will be in substantially facing contact. A first set of fasteners 36 is disposed along first distal edge 18 for engaging a complementary second set of fasteners 38 disposed along second distal edge 20. First and second sets of fasteners 36 and 38 are preferably comprised of complementary fabric tape material, such as the "Velcro" fastener material described above with reference to first and second attachment members 26 and 30. The engagement between first and second sets of fasteners 36 and 38 holds respective distal edges 18 and 20 securely together when first and second members 12 and 14 are folded together.

A children's story is imprinted with permanent, nontoxic plastisol ink on one or more flexible fabric (preferably satin) pieces 40, which are sewn together adjacent to respective edges thereof to define a book-like member with a central spine. Attached to the central spine of the storybook is an elongated third fastener 42, which extends substantially the entire length of the spine of the storybook. Third fastener 42 engages a complementary fourth fastener (not shown) attached to central portion 16. Third fastener 42 and the fourth fastener are preferably comprised of complementary fabric tape material, such as the "Velcro" material described above with reference to first and second attachment members 26 and 30. The disengagement of third fastener 42 from the fourth fastener allows the entire storybook to be removed and replaced with a different story. Fabric pieces 40 comprising the children's storybook are sandwiched between first and second inner major surfaces 32 and 34 when first and second members 12 and 14 are folded together.

Figure 6:
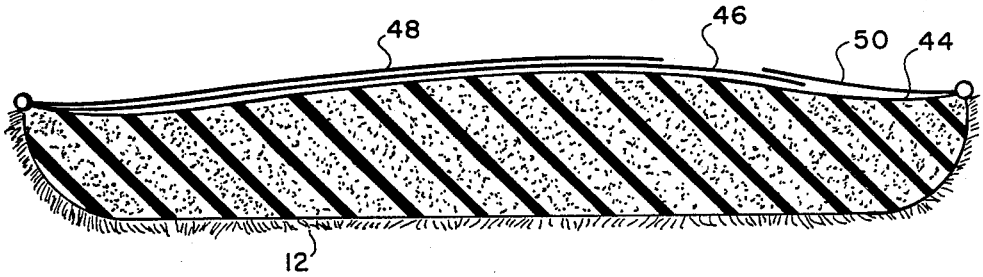
FIG. 6 is a sectional view of a portion of the device, taken along the line 6—6 in FIG. 2, illustrating the storage feature of the invention.

As best seen in FIGS. 2 and 6, first and second inner major surfaces 32 and 34 are each preferably comprised of first, second, third and fourth fabric panels 44, 46, 48 and 50. First fabric panel 44, which is the innermost panel, extends substantially the entire length and width of the corresponding inner major surface. A substantial portion of first fabric panel 44 is overlapped by second fabric panel 46 to define a first pouch therebetween. Third fabric panel 48 overlaps second fabric panel 46 to define a second pouch therebetween. Fourth fabric panel 50 overlaps the portion of first fabric panel 44 which is not overlapped by second fabric panel 46 to substantially conceal the first pouch. Each of the four fabric panels 44, 46, 48 and 50 has substantially the same width, as measured along an axis which is transverse with respect to first and second distal edges 18 and 20 and the axis of central portion 16. The length of each fabric panel 44, 46, 48 and 50, as measured along an axis parallel to first and second distal edges 18 and 20 and the axis of central portion 16, is different for each panel.

As previously mentioned, the length of first fabric panel 44 extends substantially between first and second opposite edges 52 and 54. Second fabric panel 46 has a somewhat lesser length than first fabric panel 44 and third panel 48 in turn has a substantially lesser length 46. Fourth panel 50 has the smallest length among the four fabric panels 44, 46, 48 and 50.

A carriage strap handle 56 is attached to second edge 54 adjacent to central portion 16 to facilitate the handling of device 10 when device 10 is being transported as a hand carry pack. Device 10 further includes first, second and third loops 58, 60 and 62 disposed at selected positions on first member 12. First and second loops 58 and 60 are attached to first member 12 adjacent to first edge 52 thereof and third loop 62 is attached to first member 12 adjacent to opposite second edge 54 thereof. Third loop 62 is attached at a position which is approximately coincident with the geometric center of second edge 54, while first and second loops 58 and 60 are positioned offcenter on opposite sides of the approximate geometric center of corresponding first edge 52.

Figure 3:
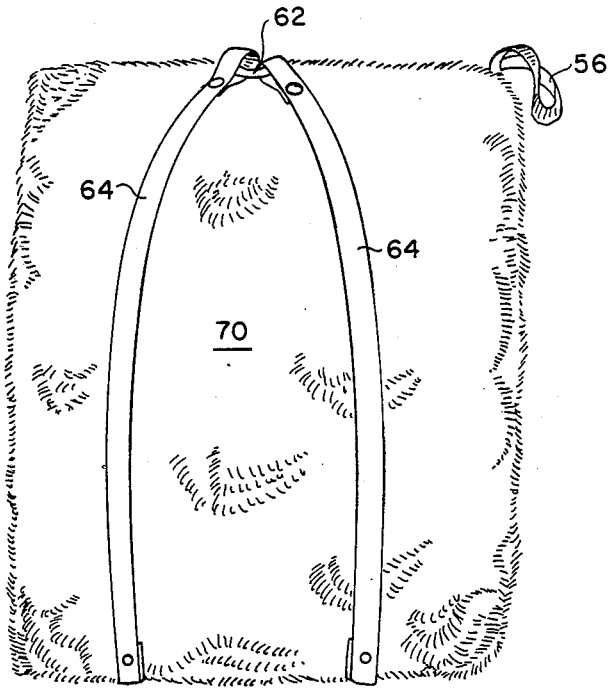
FIG. 3 is an elevational view of the device depicted in FIGS. 1 and 2, showing the attachment of straps which are used to configure the device as a backpack when the device is in a folded configuration.

Referring to FIG. 3, first, second and third loops 58, 60 and 62 are adapted for receiving a pair of elongated straps 64 to allow device 10 in its folded configuration to be carried as a backpack. Respective first ends 66 of straps 64 are passed through third loop 62, while respective second ends 68 of straps 64 are passed through respective first and second loops 58 and 60 to secure strap 64 to device 10. Straps 64 extend substantially the entire length of second member 14 in facing relationship with outer major surface 70 of second member 14.

Figure 5:
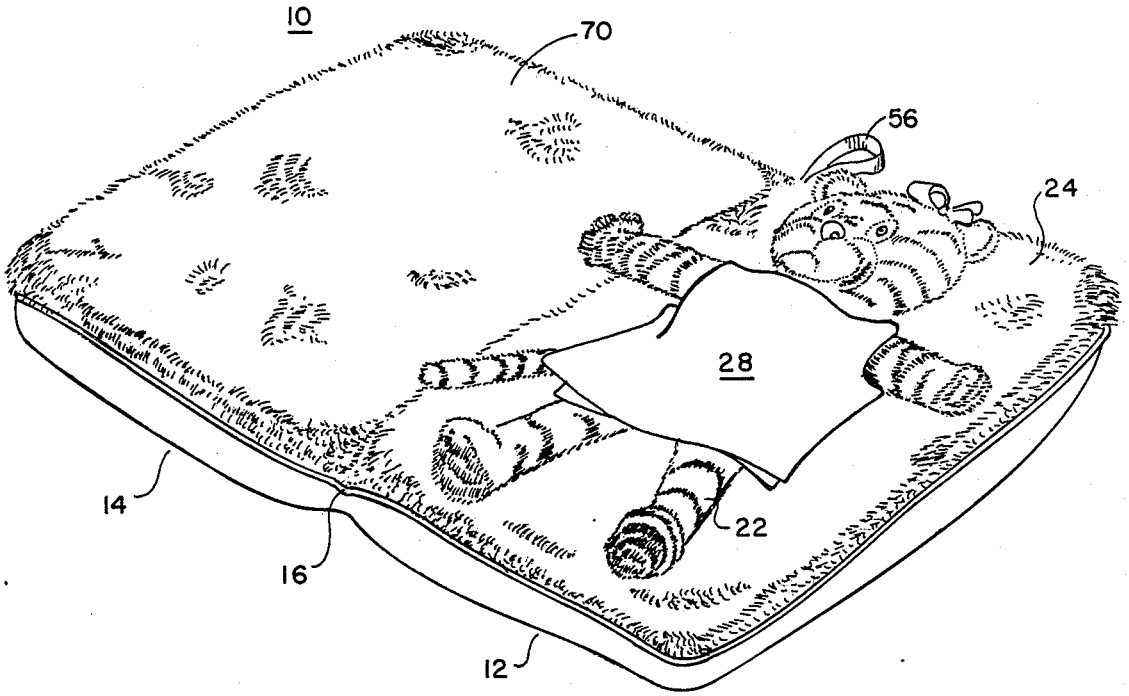
FIG. 5 is a perspective view of the device in an unfolded position with the exterior portion thereof visible.

Referring to FIG. 5, another use of device 10 is depicted. Device 10 can be unfolded and its inner major surfaces 32 and 34 placed face down on a bed or other flat surface so that outer major surfaces 24 and 70 are exposed. Outer major surface 70 associated with second member 14 is preferably a substantially smooth surface so as to serve as a head pillow for a child to sleep next to toy 22. Outer major surfaces 24 and 70 are preferably comprised of a soft material having the texture of fur or animal hair. Inner major surfaces 32 and 34 are preferably comprised of a smooth satin or silklike-material. Another use of device 10 is as a diaper changing pad. When first and second members 12 and 14 are unfolded and outer major surfaces 24 and 70 placed face down on a flat surface to expose inner major surfaces 32 and 34, a baby or other small child can be laid across first and second inner major surfaces 32 and 34 and the child's diaper can be changed quickly and comfortably for the child. The changing items, as well as any other necessities, can be stored in the pouches defined by fabric panels 44, 46, 48 and 50 comprising first and second inner major surfaces 32 and 34, as described above.

Various embodiments of the invention have been described in detail. Since it is obvious that changes in and additions to the above-described preferred embodiment may be made without departing from the nature, spirit and scope of the invention, the invention is not to be limited to said details, except as set forth in the appended claims.

What is claimed is:

1. A combined amusement and storage device comprising:

first and second members joined together along a central portion of said device, each of said members having inner and outer major surfaces with a flexible material disposed therebetween, said members for being folded relative to one another such that the respective inner major surfaces of said members are substantially in facing contact and for being unfolded relative to one another to expose the respective inner major surfaces of said members;

each member having a first panel for overlapping a portion of the corresponding inner major surface to define a first pouch, a second panel for overlapping a portion of the first panel to define a second pouch and a third panel for overlapping a portion of the corresponding inner major surface which is not overlapped by the first panel and a portion of the first panel to conceal said first pouch; and a three dimensional object attached to an outer major surface of the first member, such that when the first and second members are unfolded and their respective inner major surfaces positioned face down, the second member provides a cushioned headrest adjacent to the three dimensional object on the outer major surface of the first member.

2. The device according to claim 1 further including securing means positioned at selected locations along the respective distal edges of the first and second members to hold the respective distal edges in contact when the first and second members are folded together.

3. The device according to claim 2 wherein said three dimensional object is comprised of a stuffed toy.

4. The device according to claim 3 wherein said toy has head and torso portions, said toy being attached to the outer major surface of said first member along at least portions of the perimeter of the head and torso of the toy.

5. The device according to claim 3 wherein said toy has attachment means disposed at selected locations thereon for allowing a user to attach articles to the toy.

6. The device according to claim 5 further including an article of play clothing which is selectively attachable to said toy by said attachment means, said article of play clothing being detachable from the toy by moderate force exerted by the user.

7. The device according to claim 5 wherein said toy has head and torso portions, said attachment means being positioned at selected locations along the perimeter of the head and torso of the toy.

8. The device according to claim 2 further including a children's story imprinted on a fabric material which is removably attached to an inside portion of said device so that said fabric material is sandwiched between said first and second members when said first and second members are folded together.

9. The device according to claim 8 wherein said fabric material is attached along one edge thereof to the central portion of said device.

10. The device according to claim 2 further including handle means attached to one edge of the device adjacent to the central portion thereof to facilitate the manual engagement of said device by a user.

11. The device according to claim 2 further including first and second loops disposed adjacent to a first edge of said first member and a third loop disposed adjacent to a second edge of said first member, opposite from said first edge, said first, second and third loops for receiving a plurality of straps therethrough to allow said device to be carried as a backpack when said first and second members are folded together.

12. A device, comprising:

first and second members having a central portion disposed therebetween for joining said first and second members, said first and second members being foldable along said central portion so that respective distal edges of the first and second members are substantially in contact to define a substantially closed configuration when said members are folded along said central portion, each of said members having opposite inner and outer major surfaces the respective inner major surfaces being in facing relationship when said members are folded along said central portion;

a three dimensional object attached to the outer major surface of said first member, said three dimensional object being comprised of a stuffed toy having head and torso portions, said toy being attached to said outer major surface of said first member along at least portions of the perimeter of the head and torso portions of the stuffed toy, said toy having attachment means disposed at selected locations thereon for allowing the user to attach articles to the toy; and a children's story imprinted on fabric material, which is removably attached to said device so that said fabric material is sandwiched between the first and second members when the members are folded together.

13. The device according to claim 12 further including handle means attached to one edge of said device adjacent to the central portion to facilitate manual engagement of the device by the user.

14. The device according to claim 13 further including first and second loops disposed adjacent to a first edge of the first member and third loop disposed adjacent to a second edge of the first member, the first, second and third loops for receiving a plurality of straps therethrough to allow said device to be carried as a backpack when said first and second members are folded together.

15. The device according to claim 14 further including securing means positioned at selected locations along the respective distal edges of the first and second members to hold the respective distal edges of the first and second members in contact when the first and second members are folded together.

16. The device according to claim 15 wherein each of said members has a first panel overlapping a portion of the corresponding inner major surface to define a first pouch, a second panel overlapping a portion of the first panel to define a second pouch and a third panel overlapping a portion of the corresponding inner major surface which was not overlapped by the first panel and a portion of the first panel to conceal the first pouch.

* * * * *